US011516604B2

(12) United States Patent
Khenkin

(10) Patent No.: US 11,516,604 B2
(45) Date of Patent: Nov. 29, 2022

(54) SYSTEM AND METHOD FOR EVALUATING AN EAR SEAL USING EXTERNAL STIMULUS

(71) Applicant: Cirrus Logic International Semiconductor Ltd., Edinburgh (GB)

(72) Inventor: Aleksey S. Khenkin, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 185 days.

(21) Appl. No.: 17/090,291

(22) Filed: Nov. 5, 2020

(65) Prior Publication Data

US 2021/0400408 A1 Dec. 23, 2021

Related U.S. Application Data

(60) Provisional application No. 63/039,991, filed on Jun. 17, 2020.

(51) Int. Cl.

| | |
|---|---|
| ***H04R 29/00*** | (2006.01) |
| ***H04R 3/04*** | (2006.01) |
| ***H04R 1/10*** | (2006.01) |

(52) U.S. Cl.

CPC ..... *H04R 29/00* (2013.01); *H04R 1/1016* (2013.01); *H04R 3/04* (2013.01)

(58) Field of Classification Search

CPC ..... H04R 29/00; H04R 1/1016; H04R 3/04; H04R 1/1041; H04R 2460/01; H04R 2460/15; H04R 25/30

USPC ..... 381/60, 58, 328, 74, 380

See application file for complete search history.

(56) References Cited

U.S. PATENT DOCUMENTS

| | | | | |
|---|---|---|---|---|
| 5,577,511 | A * | 11/1996 | Killion | H04R 25/70 381/60 |
| 9,282,412 | B2 * | 3/2016 | Duisters | H04R 25/30 |
| 2002/0076057 | A1 * | 6/2002 | Voix | A61F 11/08 381/328 |
| 2009/0220096 | A1 | 9/2009 | Usher et al. | |
| 2010/0074451 | A1 | 3/2010 | Usher et al. | |

(Continued)

FOREIGN PATENT DOCUMENTS

| | | |
|---|---|---|
| JP | 2012244522 A | 12/2012 |
| WO | WO 2009023633 | 2/2009 |

OTHER PUBLICATIONS

Schulein, Robert B. et al. "In situ Subjective and Objective Acoustic Seal Performance Test for Insert Earphones." AES Convention 141, AES 60 East 42nd Street, Room 2520, New York 10165-2520. Sep. 20, 2016. pp. 1-8.

*Primary Examiner* — Xu Mei

(74) *Attorney, Agent, or Firm* — E. Alan Davis; Huffman Law Group, PC

(57) ABSTRACT

A system for evaluating a seal between an earphone of a hearing device and an ear canal that includes a first microphone positioned outside the ear canal, a second microphone positioned inside the ear canal, and a controller. The controller is configured to measure a sound level at one or more test frequencies using the first microphone, measure a sound level at the one or more frequencies using the second microphone, calculate a difference between the sound levels measured using the first and second microphones at each of the one or more test frequencies, and determine a measurement of an ear seal based on the calculated one or more differences.

17 Claims, 8 Drawing Sheets

(56) References Cited

U.S. PATENT DOCUMENTS

| | | | | |
|---|---|---|---|---|
| 2014/0146989 | A1* | 5/2014 | Goldstein | H04R 1/1016 381/380 |
| 2014/0241553 | A1* | 8/2014 | Tiscareno | H04R 1/1016 381/309 |
| 2014/0247952 | A1 | 9/2014 | Goldstein | |
| 2015/0010158 | A1* | 1/2015 | Broadley | A61F 11/14 381/58 |
| 2016/0249128 | A1 | 8/2016 | Goldstein | |
| 2019/0274595 | A1 | 9/2019 | Usher | |
| 2019/0313196 | A1 | 10/2019 | Usher | |
| 2020/0162808 | A1 | 5/2020 | Monsarrat-Chanon et al. | |
| 2021/0356843 | A1 | 11/2021 | Deo et al. | |
| 2021/0400410 | A1 | 12/2021 | Khenkin et al. | |

* cited by examiner

SYSTEM AND METHOD FOR EVALUATING AN EAR SEAL USING EXTERNAL STIMULUS

CROSS REFERENCE TO RELATED APPLICATION(S)

This application claims priority based on U.S. Provisional Application, Ser. No. 63/039,991, filed Jun. 17, 2020, entitled A System and Method for Evaluating an Ear Seal using External Stimulus, which is hereby incorporated by reference in its entirety.

BACKGROUND

In order to reduce power consumption, many personal audio devices have a dedicated "in-ear detect" function, operable to detect the presence or absence of an ear in proximity to the device. Additionally, specific for in-ear transducers (earphones), for some applications there is a need to evaluate the quality of the seal formed between the earphone and the ear canal. For example, the playback quality, in particular the bass response, is affected by the quality of the seal formed between the earphone and the ear canal. Additionally, in the realm of ear biometrics, the ear canal impulse response (ECIR) is affected by the insertion quality.

Infra-red sensors have been used in mobile phones to detect the proximity of an ear. Light sensors have been proposed to detect the insertion of earphones and headphones into or onto a user's ears. However, these non-acoustical mechanisms suffer from the drawback that they require additional hardware in the device. Furthermore, they cannot assess the seal/insertion quality.

Measuring transducer (e.g., receiver) impedance is an acoustical method that can be used to detect ear in/out status of a device, but not seal quality. It is also possible to use very low frequency (e.g., 5 Hz) probe sounds, requiring direct measurements of the sound levels at these frequencies. Such measurements, in addition to requiring specific probe signals to be generated, suffer from high noise levels and microphone response inaccuracies. Some of these techniques are described in U.S. Pat. No. 8,983,083 issued to Tiscareno et al. on Mar. 17, 2015.

SUMMARY

In one embodiment, the present disclosure provides a system for evaluating a seal between an earphone of a hearing device and an ear canal that includes a first microphone positioned outside the ear canal, a second microphone positioned inside the ear canal, and a controller. The controller is configured to measure a sound level at one or more test frequencies using the first microphone, measure a sound level at the one or more frequencies using the second microphone, calculate a difference between the sound levels measured using the first and second microphones at each of the one or more test frequencies, and determine a measurement of an ear seal based on the calculated one or more differences.

In another embodiment, the present disclosure provides a method for evaluating a seal between an earphone of a hearing device and an ear canal. The method includes measuring an internal sound level within an ear canal for each of one or more test frequencies, measuring an external sound level external to the ear canal for each of the one or more test frequencies, calculating a difference between the measured internal and external sound levels for each of the one or more test frequencies, and determining a measurement of an ear seal based on the calculated one or more differences.

In yet another embodiment, the present disclosure provides a non-transitory computer-readable medium having instructions stored thereon that are capable of causing or configuring a system for evaluating a seal between an earphone of a hearing device and an ear canal to perform operations. The operations include measuring an internal sound level within an ear canal for each of one or more test frequencies, measuring an external sound level external to the ear canal for each of the one or more test frequencies, calculating a difference between the measured internal and external sound levels for each of the one or more test frequencies, and determining a measurement of an ear seal based on the calculated one or more differences.

DETAILED DESCRIPTION

Figure 1:
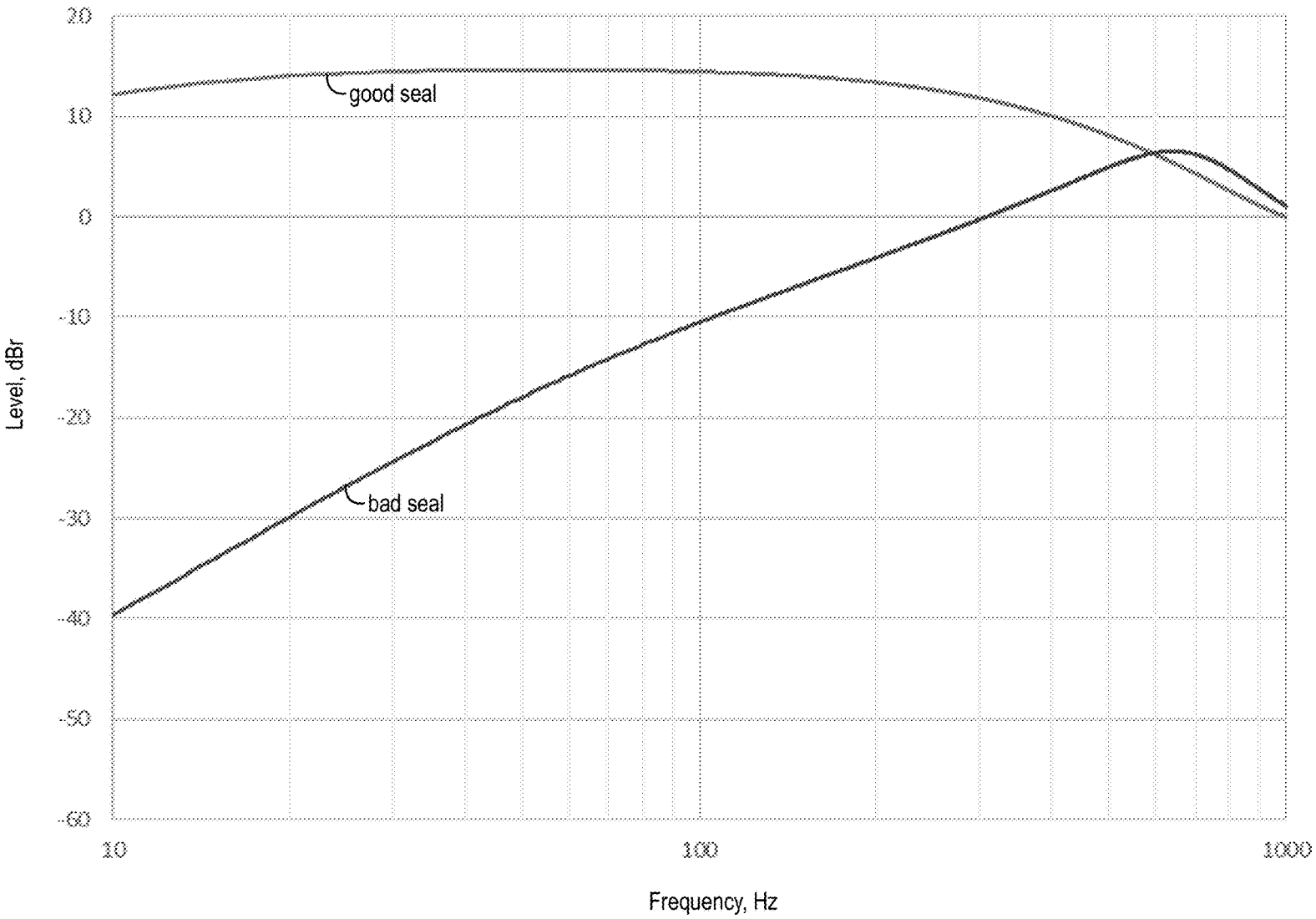
FIG. 1 is an example graph illustrating good ear seal and bad ear seal sound levels measured across a frequency spectrum in accordance with embodiments of the present disclosure.

FIG. 1 is an example graph illustrating good ear seal and bad ear seal sound levels measured across a frequency spectrum in accordance with embodiments of the present disclosure. In the graph of FIG. 1, the sound levels are measured in decibels relative to a reference signal (dBr), and the frequency range is from 10 Hz to 1000 Hz. As may be observed from the graph, in the case of a bad ear seal, there is approximately a logarithmic relationship between the response and the frequency, whereas in the case of a good ear seal, there is an approximate linear relationship between the response and the frequency. Thus, for example, the response at lower frequencies (e.g., audio range bass response) is detrimentally affected by a bad ear seal relative to the response in the case of a good ear seal. FIG. 1 illustrates an example of uses for determining the ear seal quality, e.g., to inform the system to boost low frequencies in the case of a poor ear seal and/or to inform the user of the poor seal. Furthermore, there are other uses for determining the quality of an ear seal, as described herein, and for determining whether the earphone is inserted in the user's ear canal at all.

Embodiments are described in which a system uses sound generated outside of the user's ear canal rather than by the speaker of an earphone, e.g., external noise, to estimate the quality of the seal of the earphone to the ear canal of a user. The method relies on a difference in the spectral content observed by an external microphone and an internal microphone of the earphone, such as the respective reference and error microphones typically included in active noise cancellation (ANC) earphones.

Figure 2:
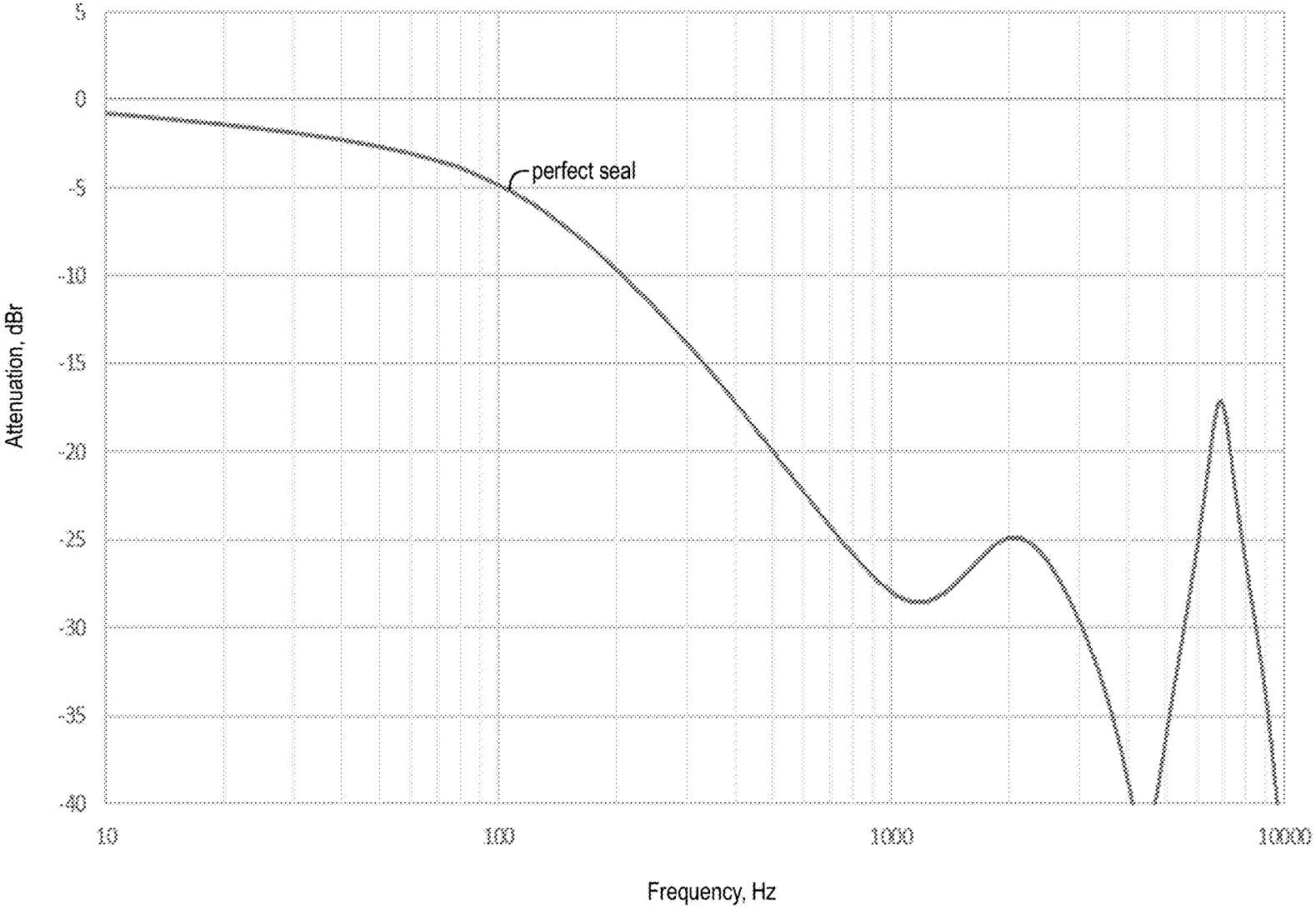
FIG. 2 is an example graph illustrating the attenuation of external sound for a zero-leak case of a sealed earphone in accordance with embodiments of the present disclosure.

FIG. 2 is an example graph illustrating the attenuation of external sound for a zero-leak case of a sealed earphone in accordance with embodiments of the present disclosure. More specifically, FIG. 2 plots the attenuation (in dBr) of leaked external acoustical signals as a function of frequency in the 10 kHz bandwidth, i.e., the external signal spectrum is normalized to 0 dB at all frequencies. That is, FIG. 2 illustrates a difference in the spectral content observed by an external microphone and an internal microphone of an earphone. Particularly, FIG. 2 shows an example of a leaked spectrum for the case of a perfect ear seal. As may be observed from FIG. 2, even a perfect seal results in some sound entering the ear canal because of finite mass of the earphone and the finite compliance of the ear seal. The resonances at high frequencies observable in FIG. 2 are formed by the ear canal geometry.

Figure 3:
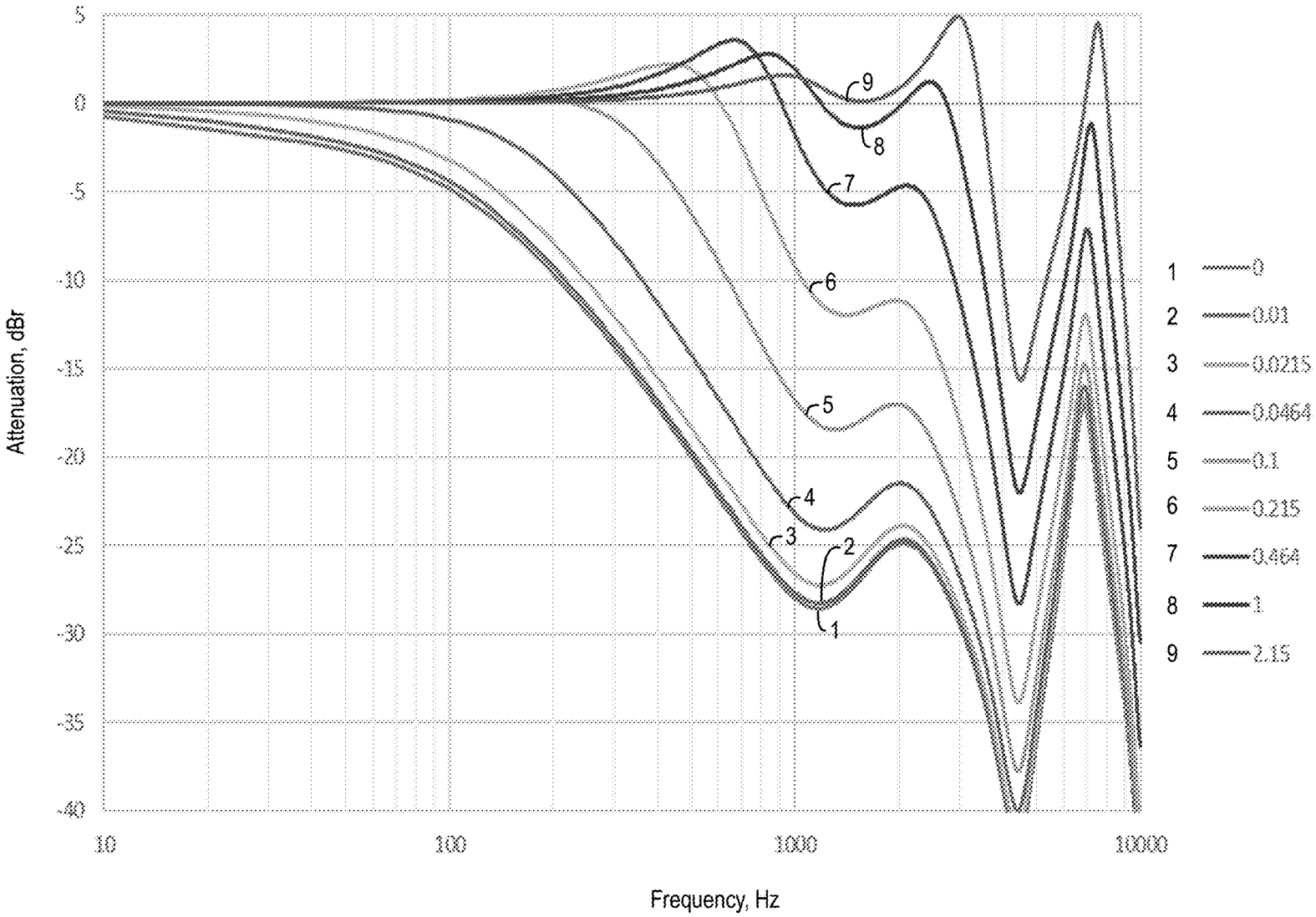
FIG. 3 is an example graph similar to FIG. 2 additionally illustrating attenuation spectra for multiple leak sizes in accordance with embodiments of the present disclosure.

FIG. 3 is an example graph similar to FIG. 2 additionally illustrating attenuation spectra for multiple leak sizes in accordance with embodiments of the present disclosure. More specifically, whereas FIG. 2 shows leaked spectra for a seal leak size of zero, FIG. 3 additionally shows leaked spectra for various seal leak sizes. Generally, the quality, or measure, of an ear seal refers to a measure of the amount of the space between an earphone of a hearing device and the ear canal of the user of the hearing device that may allow external noise to enter the ear canal and/or that may affect the quality of the sound produced by the speaker of the earphone, e.g., due to acoustical affects. In FIG. 3, the different leak sizes shown are measured in millimeters. The leak size may vary around the circumference of the ear canal since the ear canal and earphone shape do not match perfectly. Attenuation values are shown for leak sizes of 0, 0.01, 0.0215, 0.0464, 0.1, 0.215, 0.464, 1 and 2.15 millimeters.

As may be observed from FIG. 3, a strong leak dependence in the spectral shape of the leaked signal is evident across a significant portion of the bandwidth. The frequency range between 100 Hz and 1 kHz offers a clearest attenuation signature, as may be observed more readily from FIG. 4 in which the attenuation spectra of FIG. 3 are shown between 100 Hz and 1 kHz for the corresponding leak sizes.

Figure 4:
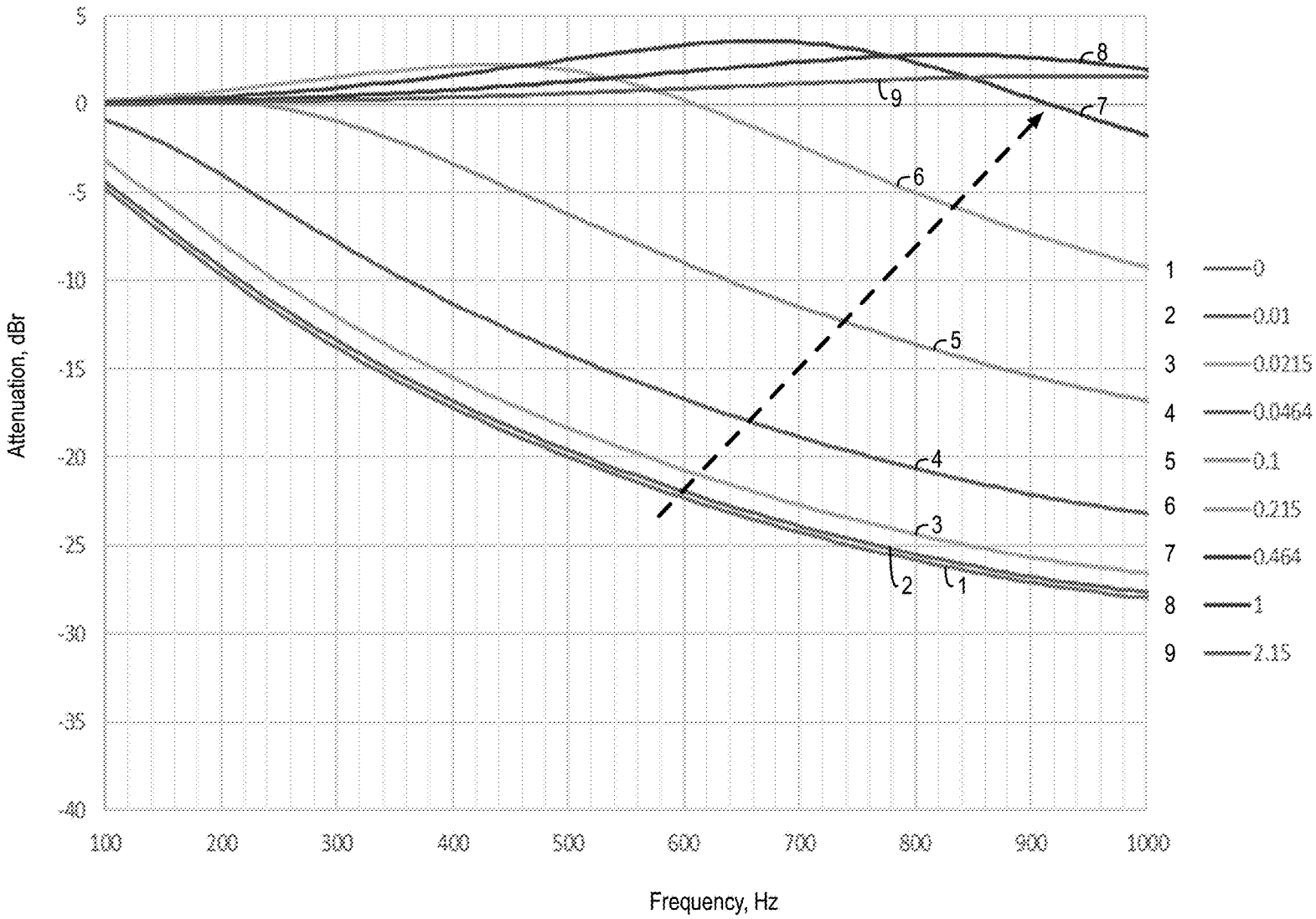
FIG. 4 is an example graph similar to FIG. 3 illustrating attenuation spectra for multiple leak sizes within a narrow frequency range in accordance with embodiments of the present disclosure.

The initial full seal (i.e., zero-leak) attenuation response that is specific to a given earphone model may be established via an ear simulator or volunteer subject measurements, for example. As may be observed from FIG. 4, because the attenuation variation is low for small leak sizes, determination of the initial full seal attenuation response may be achieved with significant confidence and used for determining an ear seal measurement, as described in more detail below. That is, although the zero-leak response may vary for different earphone designs, the strong downward slope as a function of frequency observed in FIG. 4 is typical. In particular, an increase in leak size causes the attenuation curve to flatten, as shown. The flattening may be detected by measuring the attenuation at several test frequencies, and the differences among attenuation levels may be used to evaluate the seal quality. Finally, a threshold value for the differences that indicates an "earbud out" condition may be established.

Figure 5:
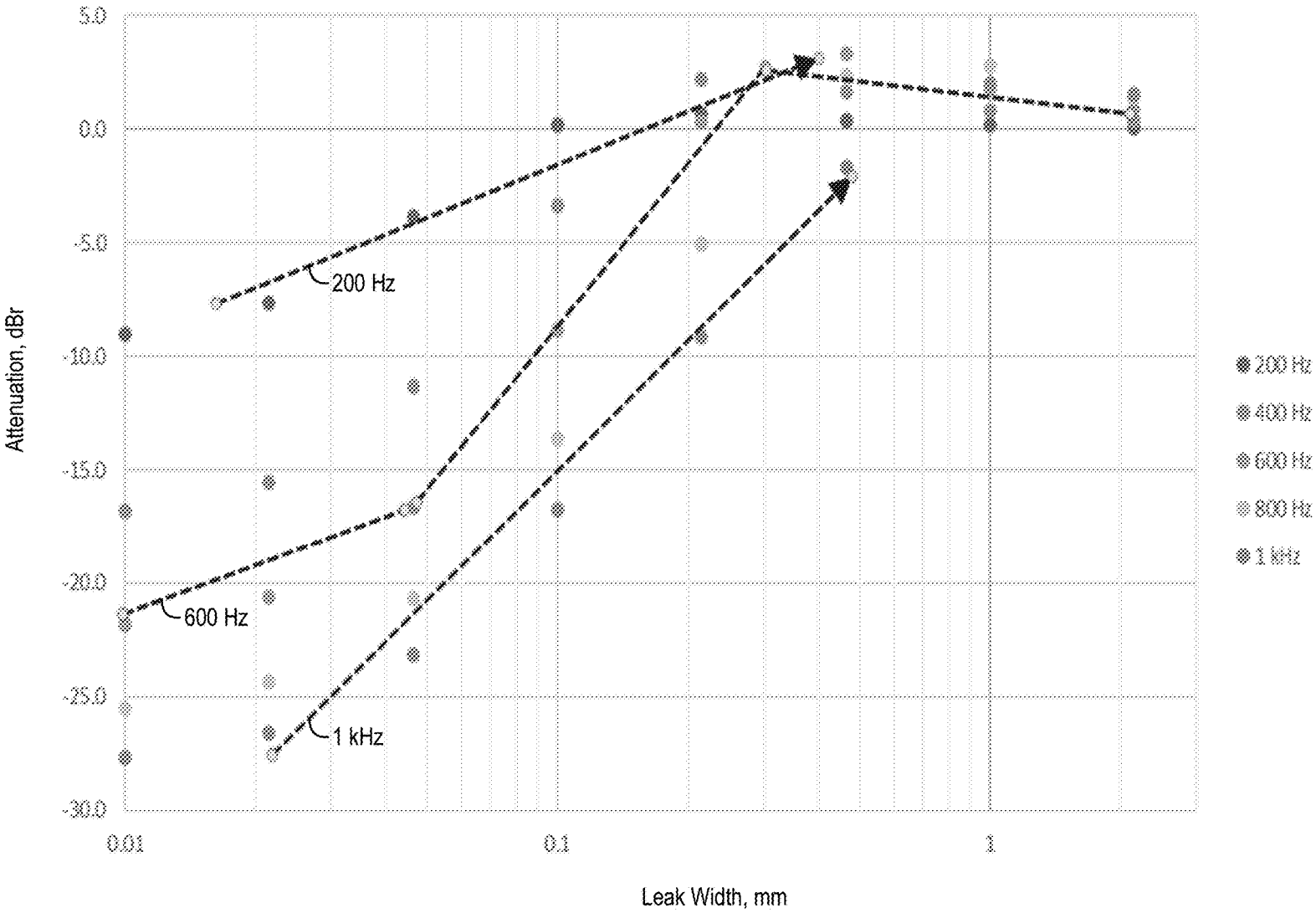
FIG. 5 is an example graph illustrating the attenuation at an error (i.e., external) microphone relative to a reference (i.e., internal) microphone at selected frequencies for various leak sizes in accordance with embodiments of the present disclosure.

FIG. 5 is an example graph illustrating the attenuation at an error (i.e., internal) microphone relative to a reference (i.e., external) microphone at selected frequencies for various leak sizes in accordance with embodiments of the present disclosure. More specifically, FIG. 5 plots the attenuation (in dBr) of leaked external acoustical signals as a function of the eight different ear seal leak sizes of FIG. 4 (excluding the zero-leak case) for each of five different frequencies, namely 200, 400, 600, 800 and 1000 Hz. Trend lines are shown with dashed arrows for the 200, 600 and 1000 Hz values.

Figure 6:
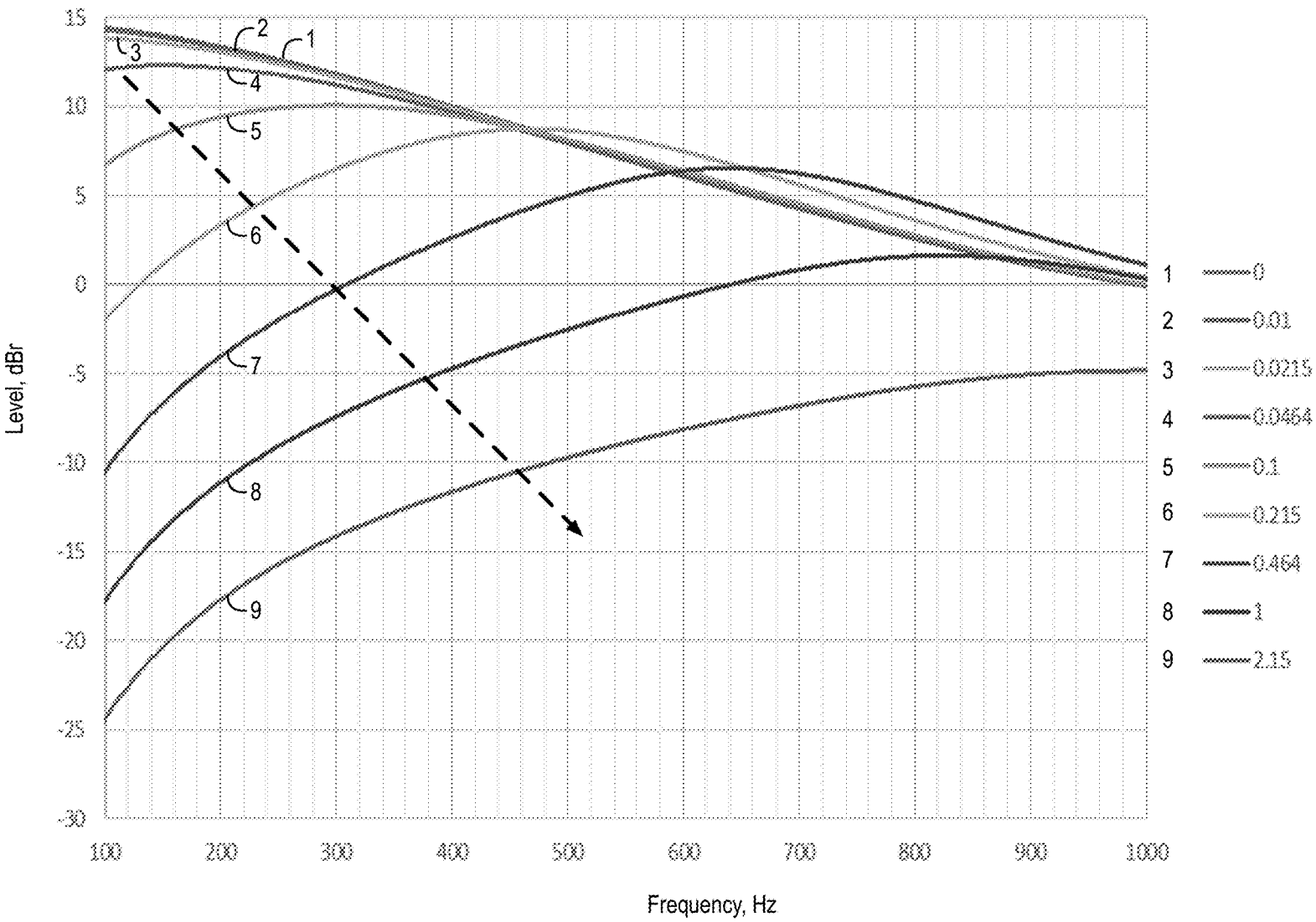
FIG. 6 is an example graph illustrating sound levels measured across a frequency spectrum for different leak sizes in accordance with embodiments of the present disclosure.

FIG. 6 is an example graph illustrating sound levels generated by the earbud and measured by an error (i.e., internal) microphone across a frequency spectrum for different leak sizes in accordance with embodiments of the present disclosure. The levels represent low-frequency response of the earbud. FIG. 6 shows the same phenomenon as FIG. 1 but for the nine different leak sizes corresponding to those of FIGS. 3 through 5. As may be observed from the graph of FIG. 6, the relationship between the low-frequency response level and the source frequency tends toward a logarithmic relationship as the seal leak size increases; whereas, the relationship between the response and the frequency tends toward a linear as the seal leak size decreases.

Figure 7:
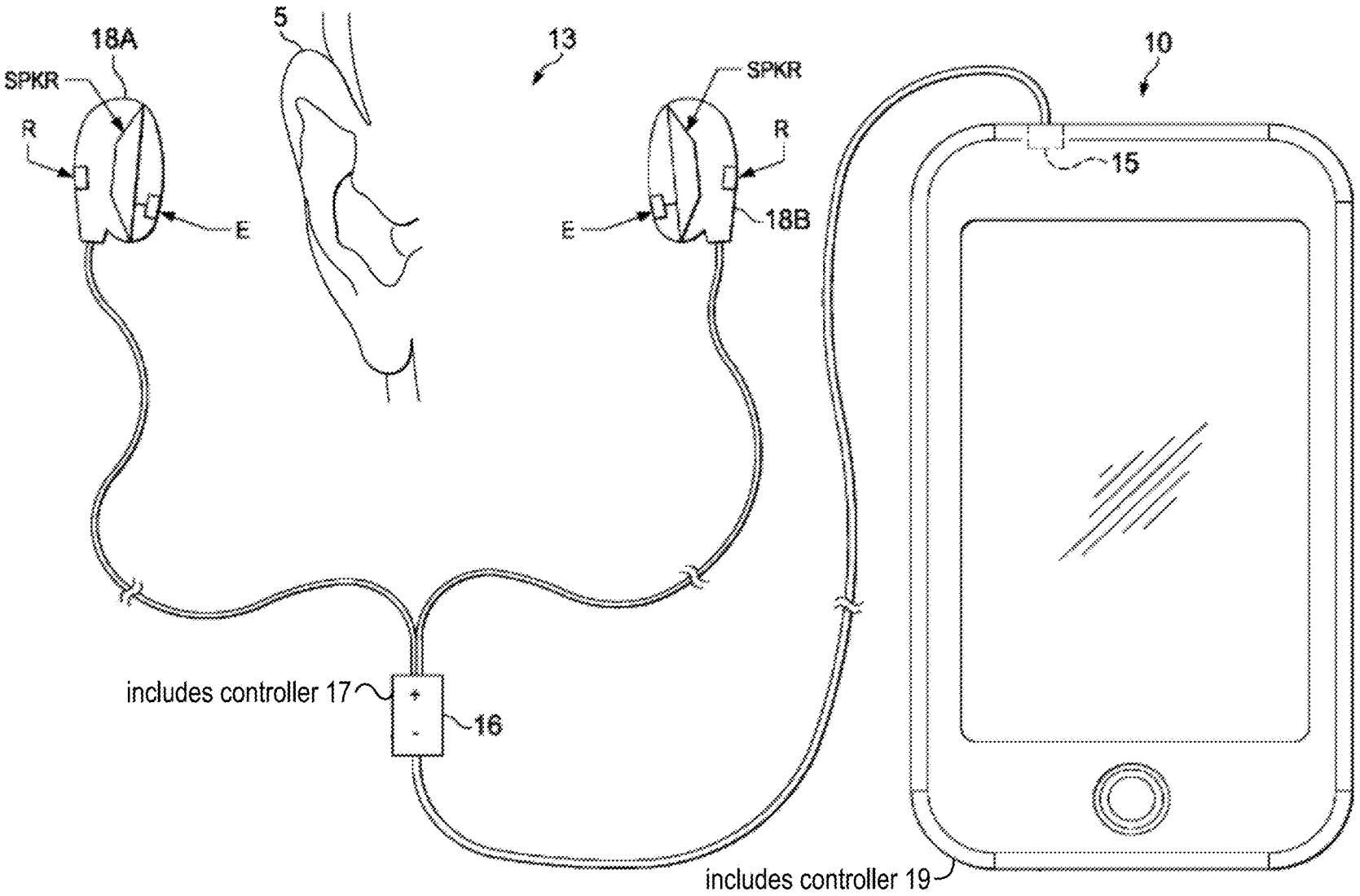
FIG. 7 is an example system that may be employed to evaluate an ear seal using an external stimulus in accordance with embodiments of the present disclosure.

FIG. 7 is an example system 100 that may be employed to evaluate an ear seal using an external stimulus in accordance with embodiments of the present disclosure. The system 100 includes a hearing device 13 coupled with a portable audio device 10, such as a mobile telephone or other audio device. The hearing device 13 may include a combox 16, a left earphone 18A, and a right earphone 18B. The left earphone 18A is shown in proximity to a human ear 5 for insertion therein, and the right earphone 18B is for insertion in the other ear (not shown). As used in this disclosure, the term "earphone" broadly includes any loudspeaker, internal microphone, external microphone and structure associated therewith that is intended to be inserted within a listener's ear canal or otherwise acoustically coupled to same, and includes without limitation earphones, earbuds, headsets and other similar devices that may be inserted into a human ear canal or otherwise acoustically coupled to same. Furthermore, it should be understood that the embodiments described herein may be used to determine ear seal quality for earphones of various different shapes, sizes and styles.

Each of the earphones 18A and 18B (referred to generically as earphone 18 and collectively as earphones 18) includes a reference microphone R, an error microphone E and a speaker SPKR. When the earphone 18 is inserted into an ear canal, the reference microphone R is external to the ear canal and the error microphone E is internal to the ear canal. The reference microphone R, also referred to as the external microphone, measures the ambient, or external, acoustic environment. The error microphone E, also referred to as the internal microphone, measures the attenuated ambient audio within the ear canal combined with the audio reproduced by the speaker SPKR. The speaker SPKR may reproduce distant speech received by mobile audio device 10, along with other local audio events such as ringtones, stored audio program material, injection of near-end speech (i.e., the speech of the user of mobile audio device 10) to provide a balanced conversational perception, and other audio that requires reproduction by mobile audio device 10, such as sources from webpages or other network communications received by mobile audio device 10 and audio indications such as a low battery indication and other system event notifications.

The hearing device 13 may include a controller 17, e.g., in the combox 16 or within one or both of the earphones 18, that performs various operations or functions described herein to determine ear seal quality using differences between sound levels measured on the reference (external) microphone R and the error (internal) microphone E. The operations may include calculating differences between the measured sound levels at the microphones, e.g., at one or more test frequencies, and determining the ear seal quality based on the calculated differences. The controller 17 may also perform actions based on the determined ear seal quality that may improve the listening experience for the user of the hearing device 13. The controller 17 may include a processing element that fetches and executes program instructions. The controller 17 may also include volatile and non-volatile memory for storing data and program instructions executable by the controller 17. The controller 17 may also include an audio coder/decoder (CODEC) circuit (not shown) that receives the signals from reference microphone R and error microphone E and generates signals to the speaker SPKR.

The audio device 10 also includes a controller 19 that may perform some of the operations to determine the ear seal quality and/or perform actions based on the determined ear seal quality that may improve the listening experience for the user. The controller 19 may be included in an integrated circuit (IC) of the audio device 10. The controller 19 may also include an audio CODEC circuit and volatile and non-volatile memories (not shown). The audio device 10 may include an audio port 15 for connecting to the hearing device 13. The audio port 15 may be communicatively coupled to a radio frequency (RF) circuit (not shown) and the controller 19 within the audio device 10, thus permitting communication with components of the hearing device 13. The RF circuit may include a wireless telephone transceiver. In other embodiments, the hearing device 13 may connect wirelessly to the mobile audio device 10, e.g., via Bluetooth or other short-range wireless technology.

The hearing device 13 and/or mobile audio device 10 may include ANC circuits and features that inject an anti-noise signal into speaker SPKR to improve intelligibility of the distant speech and other audio reproduced by speaker SPKR. In general, the ANC system measures ambient acoustic events (as opposed to the output of speaker SPKR and/or near-end speech) impinging on reference microphone R, and by also measuring the same ambient acoustic events impinging on error microphone E, ANC processing circuits adapt an anti-noise signal generated using the output of reference microphone R to have a characteristic that minimizes the amplitude of the ambient acoustic events at error microphone E. In some embodiments, the hearing device 13 and/or audio device 10 may also include a near speech microphone that may be employed in ANC operation.

In some embodiments of the disclosure, the circuits and techniques disclosed herein may be incorporated in a single integrated circuit that includes control circuits and other functionality for implementing the hearing device 13 and/or the portable audio device 10, such as an MP3 player-on-a-chip integrated circuit. In these and other embodiments, the circuits and techniques disclosed herein may be implemented partially or fully in software and/or firmware embodied in computer-readable media and executable by a controller or other processing device, such as a controller that may perform operations as described herein. The controller may include an electronic circuit capable of fetching program instructions stored in addressed memory locations and executing the fetched instructions. The IC may also include a non-volatile memory for storing threshold values as described in more detail below.

Figure 8:
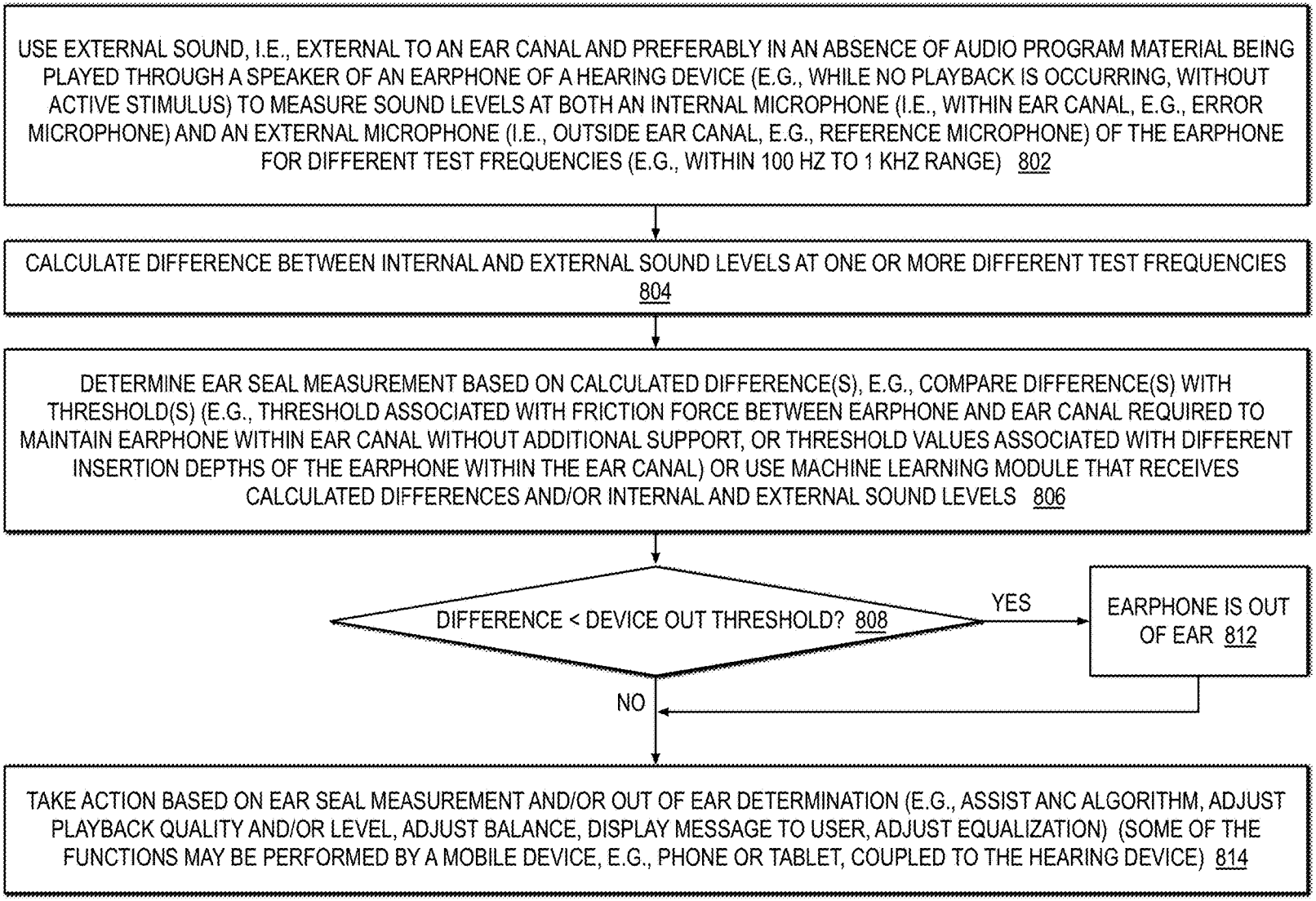
FIG. 8 is an example flowchart illustrating operation of a system that evaluates an ear seal using an external stimulus in accordance with embodiments of the present disclosure.

FIG. 8 is an example flowchart illustrating operation of a system, e.g., system 100 of FIG. 7, that evaluates an ear seal using an external stimulus in accordance with embodiments of the present disclosure. The operations described are performed for each of the earphones 18 of a hearing device 13. Operation begins at block 802.

At block 802, sound levels are measured simultaneously at an external microphone (e.g., reference microphone R of FIG. 7) and an internal microphone (e.g., error microphone E of FIG. 7) of a hearing device (e.g., hearing device 13 of FIG. 7) in the presence of external sound. The sound levels are measured at one or more different test frequencies. In one embodiment, the test frequency or frequencies are in the 100 Hz to 1000 Hz range as shown in FIG. 4. The sound measured is generated external to the ear canal. Preferably, measuring the external sound involves measuring sound levels in the absence of audio being played through the earphone speaker (e.g., speaker SPKR of FIG. 7), e.g., while no playback is occurring or any other active stimulus such that the external sound is external noise. Because the external sound may have a diverse frequency content, the system extracts, or isolates, the signal power of the external sound at the desired test frequency or frequencies. In one embodiment, a Fast Fourier Transform (FFT) is performed on the external sound to obtain frequency bins that include the desired test frequency or frequencies. In another embodiment, one or more notch filters are employed to isolate the desired test frequency or frequencies. Other frequency isolation techniques may be employed. Additionally, since the system may not have control over the frequency content of the external sound, the system may measure the levels at one or more of the test frequencies, detect that the signal level is not sufficiently high to determine an ear seal measurement with acceptable confidence, and in response use measured levels at different one or more test frequencies for which the signal level of the external sound is sufficiently high. The sound level measurements may be performed by a controller 17 of the hearing device (e.g., hearing device 13 of FIG. 7) and/or of the mobile audio device (e.g., mobile audio device 10 of FIG. 7). Operation proceeds to block 804.

At block 804, a difference between the internal and external sound levels measured at block 802 is calculated for each of the one or more test frequencies. In one embodiment, calculating the differences may involve normalizing the external signal to 0 dB at the test frequencies. The sound level differences may be calculated by a controller of the hearing device and/or of the mobile audio device (e.g., controller 17 and/or controller 19). Operation proceeds to block 806.

At block 806, an ear seal measurement is determined based on the difference or differences calculated at block 804. In one embodiment, the differences are compared against thresholds associated with different ear seal qualities, or leak sizes. For example, a difference of X (e.g., −20) dBr may be associated with a leak size of Y (e.g., 0.01) millimeters. In one embodiment, the thresholds are determined a priori for a given earphone model. In another embodiment, the thresholds are determined for a generic earphone, e.g., an expected value from a sample of different earphones tested. In one embodiment, at least one of the thresholds may be associated with a minimal friction force between the earphone and an ear canal that is required to keep the earphone within the ear canal without requiring additional support. In other words, the threshold corresponds a condition in which the leak size is so large that the earphone is no longer held by friction in the ear canal and may be about to fall out absent additional support. Such a threshold may be helpful to define a leak size corresponding to a loosely inserted earbud condition. Leak sizes larger than that are not of concern and the earphone may be declared out of the ear canal for relevant purposes. In one embodiment, different thresholds may be associated with different insertion depths of the earphone within the ear canal. For example, a separate determination of insertion depth may be obtained (e.g., from high frequency response shape), and there may be a correlation between ear seal leak size and insertion depth such that the leak size determination according to embodiments described herein may be used as an independent confirmation of the insertion depth. In one embodiment, a trained machine learning module may perform the ear seal measurement determination. The machine learning module may receive and use the sound level differences calculated at block 804 and/or the sound levels measured at block 802. The received calculated sound level differences and/or measured sound levels may be provided as input to the machine learning module both during a training mode and during an operational mode. Operation proceeds to decision block 808.

At decision block 808, a determination is made whether the difference calculated at block 804 (e.g., for a given test frequency) is less than a predetermined threshold, referred to as a "device out" threshold. If so, operation proceeds to block 812; otherwise, operation proceeds to block 814.

At block 812, an indication that the earphone is out of the ear canal is stored. The "device out" indication may be used as a trigger for other actions, e.g., as described with respect to block 814.

At block 814, an action is taken based on the ear seal measurement made at block 806 and/or the "device out" indication determined at blocks 808 and 812. The actions may include, but are not limited to: using the ear seal measurement and/or the "device out" indication to assist an ANC algorithm employed by the hearing device 13 and/or mobile audio device 10; adjust the playback quality and/or level; adjust the balance between the right and left earphones; adjust the equalization of the earphone, e.g., boost the bass level; display a message to the user, e.g., "earphone is out, please replace" or "ear seal quality low, please re-insert earphone." As described herein, in some embodiments the operations described with respect to FIG. 8 may be performed entirely by the hearing device 13 itself (e.g., controller 17 within the combox 16), whereas in other embodiments some of the operations may be performed by the mobile audio device 10 coupled to the hearing device 13.

Advantages of the embodiments described herein may include the fact that the seal quality may be measured quiescently, without an active stimulus. The embodiments benefit from a noisy environment, as they may use external noise as the stimulus in contrast conventional methods, which makes the disclosed embodiments valuable as an independent leak evaluation method. The embodiments may be used in conjunction with other methods by taking over the seal estimate task from the other methods in noisy environments as needed.

Furthermore, the embodiments may be fine-tuned to a great degree of seal assessment accuracy for a known earbud design. For example, the thresholds may be determined with a high degree of accuracy during development, manufacturing and test of the known hearing device 13 design. For another example, a machine learning module may be trained during development, manufacturing and test of the known hearing device 13 design to determine the ear seal measurement to a high degree of accuracy. Additionally, the embodiments may be used as a noisy independent measure of the earbud insertion depth for ear biometrics. The embodiments may also be used to assist an acoustic noise cancellation (ANC) algorithm. The embodiments may also be used to adjust playback quality and level to compensate for leak impact.

It should be understood that the measurement of the ear seal determined based on the calculated difference between the internal and external sound levels may be expressed in relative terms rather than (or in addition to) absolute terms such as size (e.g., millimeters), depending upon the application in which the ear seal measurement is used. For example, assume the ear seal measurement is used to adjust the balance on right and left earphones. In such case, the right and left ear seal measurements may simply be unitless values that are used to adjust the balance based on a comparison of the unitless values to one another.

Although embodiments have been described in which the external sound that is measured both externally and internally to the ear canal and used to determine the ear seal measurement is noise uncontrolled by the system, other embodiments are contemplated in which the external sound is largely controlled by the system. For example, embodiments are contemplated in which a mobile listening device, e.g., mobile phone, plays sound, e.g., upon request of the user, that is measured both externally and internally to the ear canal and used to determine the ear seal measurement. The sound played by the listening device may include the one or more test frequencies and, in some embodiments, may be only the one or more test frequencies, thereby eliminating the need to separate out the test frequencies from other frequency components of the measured sound.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, unless otherwise indicated, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure refers to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments, likewise, with the benefit of this disclosure, will be apparent to those having ordinary skill in the art, and such embodiments should be deemed as being encompassed herein. All examples and conditional language recited herein are intended for pedagogical objects to aid the reader in understanding the disclosure and the concepts contributed by the inventor to furthering the art and are construed as being without limitation to such specifically recited examples and conditions.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

Finally, software can cause or configure the function, fabrication and/or description of the apparatus and methods described herein. This can be accomplished using general programming languages (e.g., C, C++), hardware description languages (HDL) including Verilog HDL, VHDL, and so on, or other available programs. Such software can be disposed in any known non-transitory computer-readable medium, such as magnetic tape, semiconductor, magnetic disk, or optical disc (e.g., CD-ROM, DVD-ROM, etc.), a network, wire line or another communications medium, having instructions stored thereon that are capable of causing or configuring the apparatus and methods described herein.

The invention claimed is:

1. A system for evaluating a seal between an earphone of a hearing device and an ear canal, comprising:

a first microphone positioned outside the ear canal;

a second microphone positioned inside the ear canal; and a controller configured to:

measure a sound level at one or more test frequencies using the first microphone;

measure a sound level at the one or more frequencies using the second microphone;

calculate a difference between the sound levels measured using the first and second microphones at each of the one or more test frequencies; and determine a measurement of an ear seal based on the calculated one or more differences;

wherein the controller is configured to compare the calculated one or more differences with one or more threshold values to determine the ear seal measurement; and wherein at least one of the one or more threshold values is associated with a friction force between the earphone and the ear canal similar to, or less than, that is required to maintain the earphone positioned within the ear canal without additional support; and/or wherein the one or more threshold values are associated with one or more insertion depths of the earphone within the ear canal.

2. The system of claim 1, wherein the one or more test frequencies comprise a plurality of different test frequencies;

wherein the controller is configured to calculate a difference between the measured internal and external sound levels for each of the plurality of test frequencies; and wherein the controller is configured to determine the ear seal measurement based on the plurality of calculated differences.

3. The system of claim 1, wherein the internal sound level is measured using a microphone of the earphone internal to the ear canal when inserted therein; and wherein the external sound level is measured using a microphone of the earphone external to the ear canal.

4. The system of claim 1, wherein the one or more test frequencies are selected from the range 100-1000 Hertz.

5. The system of claim 1, wherein the system is wholly implemented on the hearing device.

6. The system of claim 1, wherein the system is implemented partly on the hearing device and partly on a controller provided on a host device coupled with the hearing device.

7. The system of claim 1, wherein the controller comprises a trained machine learning module arranged to determine the ear seal measurement based on the calculated one or more differences and/or the measured sound levels.

8. The system of claim 1, wherein said the internal and external sound levels are measured in an absence of audio program material being played through a speaker of the earphone.

9. A method for evaluating a seal between an earphone of a hearing device and an ear canal, comprising:

measuring an internal sound level within an ear canal for each of one or more test frequencies;

measuring an external sound level external to the ear canal for each of the one or more test frequencies;

calculating a difference between the measured internal and external sound levels for each of the one or more test frequencies; and determining a measurement of an ear seal based on the calculated one or more differences;

wherein said determining the ear seal measurement comprises comparing the calculated one or more differences with one or more threshold values; and wherein at least one of the one or more threshold values is associated with a friction force between the earphone and the ear canal similar to, or less than, that is required to maintain the earphone positioned within the ear canal without additional support; and/or wherein the one or more threshold values are associated with one or more insertion depths of the earphone within the ear canal.

10. The method of claim 9, wherein the one or more test frequencies comprise a plurality of different test frequencies;

wherein said calculating comprises calculating a difference between the measured internal and external sound levels for each of the plurality of test frequencies; and wherein said determining the ear seal measurement is based on the plurality of calculated differences.

11. The method of claim 9, wherein said measuring the internal sound level is performed using a microphone of the earphone internal to the ear canal when inserted therein; and wherein said measuring the external sound level is performed using a microphone of the earphone external to the ear canal.

12. The method of claim 9, wherein the one or more test frequencies are selected from the range 100-1000 Hertz.

13. The method of claim 9, wherein the method is performed by a system or circuit wholly implemented on the hearing device.

14. The method of claim 9, wherein the method is performed by a system or circuit; and wherein the system or circuit is implemented partly on the hearing device and partly on a controller provided on a host device coupled with the hearing device.

15. The method of claim 9, wherein the method is performed by a system or circuit comprising a trained machine learning module arranged to perform said determining the ear seal measurement based on the calculated one or more differences and/or the measured sound levels.

16. The method of claim 9, wherein said measuring the internal and external sound levels is performed in an absence of audio program material being played through a speaker of the earphone.

17. A non-transitory computer-readable medium having instructions stored thereon that are capable of causing or configuring a system for evaluating a seal between an earphone of a hearing device and an ear canal to perform operations comprising:

measuring an internal sound level within an ear canal for each of one or more test frequencies;

measuring an external sound level external to the ear canal for each of the one or more test frequencies;

calculating a difference between the measured internal and external sound levels for each of the one or more test frequencies; and determining a measurement of an ear seal based on the calculated one or more differences;

wherein said determining the ear seal measurement comprises comparing the calculated one or more differences with one or more threshold values; and wherein at least one of the one or more threshold values is associated with a friction force between the earphone and the ear canal similar to, or less than, that is required to maintain the earphone positioned within the ear canal without additional support; and/or wherein the one or more threshold values are associated with one or more insertion depths of the earphone within the ear canal.

* * * * *